US006155081A

United States Patent [19]

Frullini et al.

[11] Patent Number: 6,155,081

[45] Date of Patent: Dec. 5, 2000

[54] APPARATUS FOR DRIVING STITCHES OF TEXTILE ARTICLES

[75] Inventors: Alberto Frullini; Paolo Frullini, both of Florence, Italy

[73] Assignees: Fabritex S.R.L.; Sangiacomo S.P.A., both of Italy; part interest to each

[21] Appl. No.: 09/253,407

[22] Filed: Feb. 19, 1999

[30] Foreign Application Priority Data

Feb. 20, 1998 [IT] Italy ..... FI/98/A/40

[51] Int. Cl.[7] ..... D04B 9/40

[52] U.S. Cl. ..... 66/58; 66/148

[58] Field of Search ..... 66/147, 148, 58, 66/59, 14, 7, 95, 104

[56] References Cited

U.S. PATENT DOCUMENTS

| | | | |
|---|---|---|---|
| 1,544,085 | 6/1925 | Williams | 66/148 |
| 1,612,684 | 12/1926 | Williams | 66/148 |
| 1,743,948 | 1/1930 | Williams | 66/148 |
| 2,062,935 | 12/1936 | Roinestad | 66/148 |
| 2,107,548 | 2/1938 | Riggs et al. | 66/148 |

*Primary Examiner*—Danny Worrell

*Attorney, Agent, or Firm*—McGlew and Tuttle, P.C.

[57] ABSTRACT

Apparatus for driving stitches of textile articles is provided with, at least one element (1) including of a body with a stem (10) associated to a support means and with its free end exhibiting a seat (12) for a leading portion or end of a member having a stitch (7) thereon to be exchanged between said body and said element (1) after the housing of the leading portion or end of said member (12) into the seat (12) of said element (1). The at least one element (1) is provided, in correspondence of its free end on one side of the seat (12), with a substantially wedge-shaped appendix (13).

15 Claims, 28 Drawing Sheets

APPARATUS FOR DRIVING STITCHES OF TEXTILE ARTICLES

The present invention refers to an apparatus for driving stitches of textile articles.

BACKGROUND OF THE INVENTION

The document U.S. Pat. No. 5,586,453 discloses an apparatus comprising means for the removal of stitches of a textile article from the needles of knitting machine to transfer the same stitches onto other needles of the same machine or onto external members such as the spikes of a hooking-up machine. However, this known apparatus is intended only to handle stitches which are fitted on needles of latch- or slide-type and, accordingly, it is not able to operate stitches fitted on different needles, for example of "the bearded" type, used in the Cotton knitters.

SUMMARY AND OBJECTS OF THE INVENTION

The main object of the present invention is to overcome the noted drawbacks.

The advantages deriving from the present invention lie essentially in that it is possible to drive one or more stitches belonging to the last rank of an article knitted on a machine provided with any type of needles, either of latch, slide or bearded type, and disposed over one or more fronts of straight, circular, mixed or, more generally, any possible form; that it is possible to withdraw stitches from the knitting needles to transfer them afterwards onto members which, in turn, are able to lay them down onto other support means for finish operations or for a further transfer thereof onto suitable members such as the needles of either the same or other machine, also for the continuation of the knitting in a form other than the one initially performed; that, owing to the possibility of driving also all the stitches of the last knitted rank, it is also possible to move the whole article either between different regions of a same machine or towards other operating stations; that an apparatus according to the invention is relatively simple to make, cost-effective and reliable even after a prolonged service time.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DESCRIPTION OF THE PREFERRED EMBODIMENTS

Figure 2:
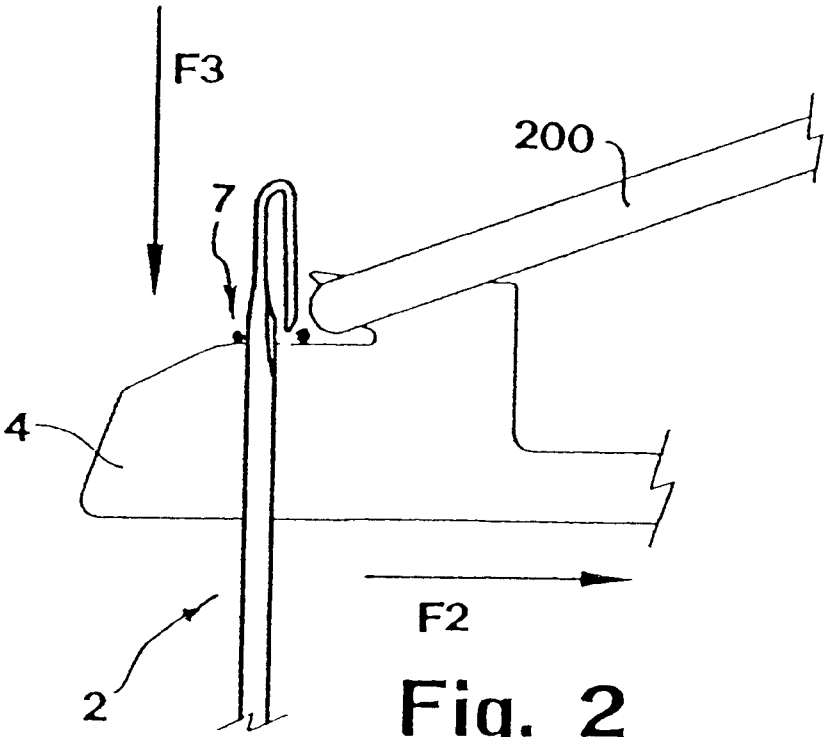
FIGS. 1–5 show schematically the stitch-removing step of a textile machine provided with bearded needles and movable sinkers.

Substantially, an apparatus according to the invention comprises means for removing one or more stitches from respective knitting needles and for the transfer and subsequent deposition thereof onto other members of the same or other textile machine. The apparatus in question may also comprise means for the movement and/or dwell of each stitch being withdrawn from said removal means. Moreover, means are suitably provided for the support of each thus treated stitch, during operations like that for driving the stitches onto the knitting needles of a textile machine or for hooking-up the article.

The particular shape of the means—to be described in greater details later on with reference to different embodiments thereof—makes it possible to determine all the time, and with the highest reliability, the so-called "covering" condition by simply moving close to one another the corresponding ends of the members these means consist of. Such covering condition is necessary to ensure the correct transfer of the thread loops making up the stitches, from a member on which each loop results fitted, to a contiguous member, without any risk for even partial failure of thread hold. The use of these means makes it also possible to automate the steps of the implemented method, owing to the simplicity of the movements operated by the members which, in the whole, define the said means and can mutually exchange one or more stitches according to a preset order.

Reduced to its basic structure, and reference being made to the figures of the attached drawings, an apparatus according to the invention comprises one or more elements (1), indicated as "pushers", each of which is made up of a flat body with a stem (10) having straight longitudinal axis, associated to corresponding support and driving means—to be described below—and whose free end (11) exhibits a seat (12) of a shape corresponding to that of the head of the needle with which it is intended to interact in the course of the stitch-changeover between pusher and needle. Advantageously, according to the invention, each of said pushers (1) is provided, in correspondence of the respective free end (11), on one side of the said seat (12), with a substantially wedge-like appendix (13). The free end (130) of appendix (13) may also be suitably tapered at its vertex and bent inwardly of said seat (12).

Figure 3:
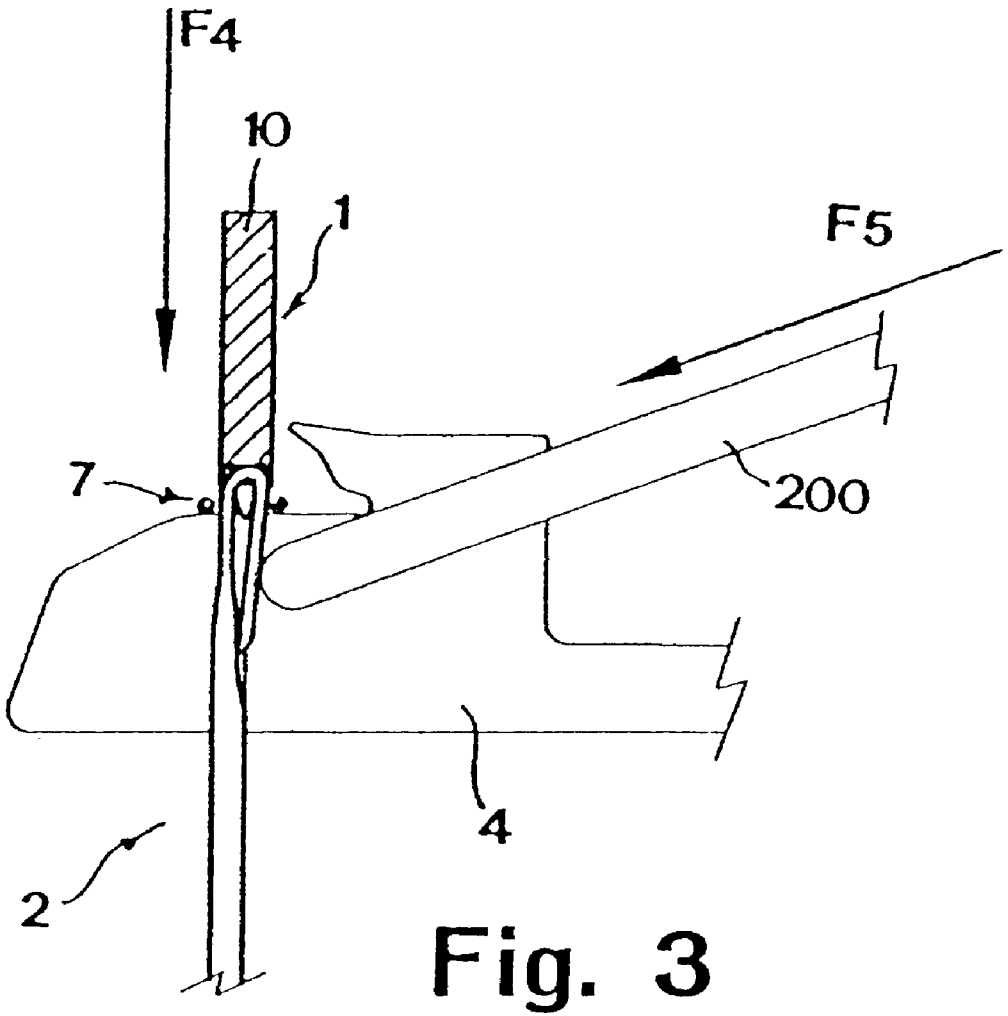
Figure 8:
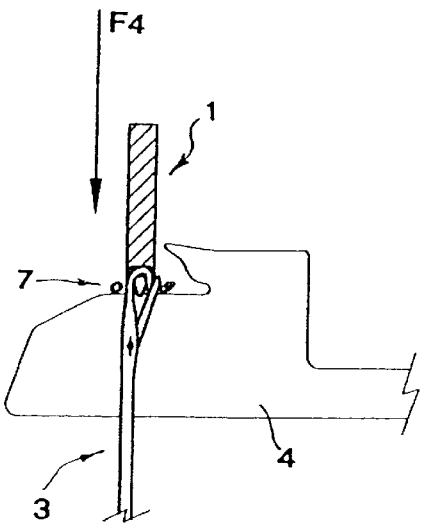
FIGS. 6–10 is a schematic representation likewise in the preceding figures, of a textile machine provided with latch needles and movable sinkers.
Figure 7:
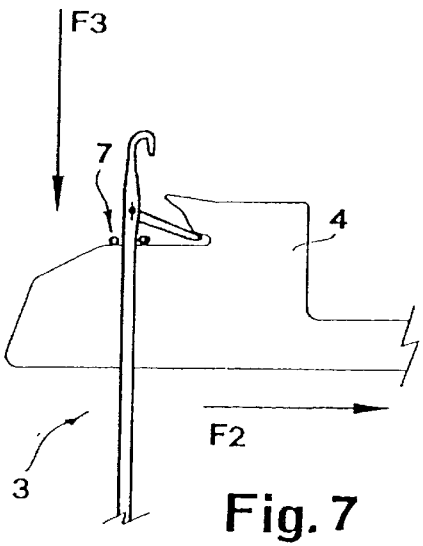
Figure 6:
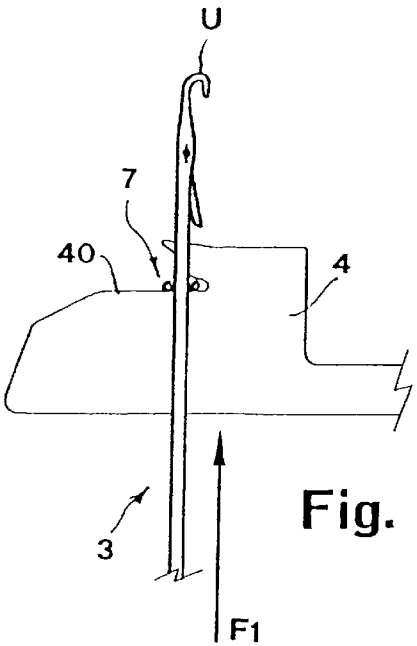
Figure 10:
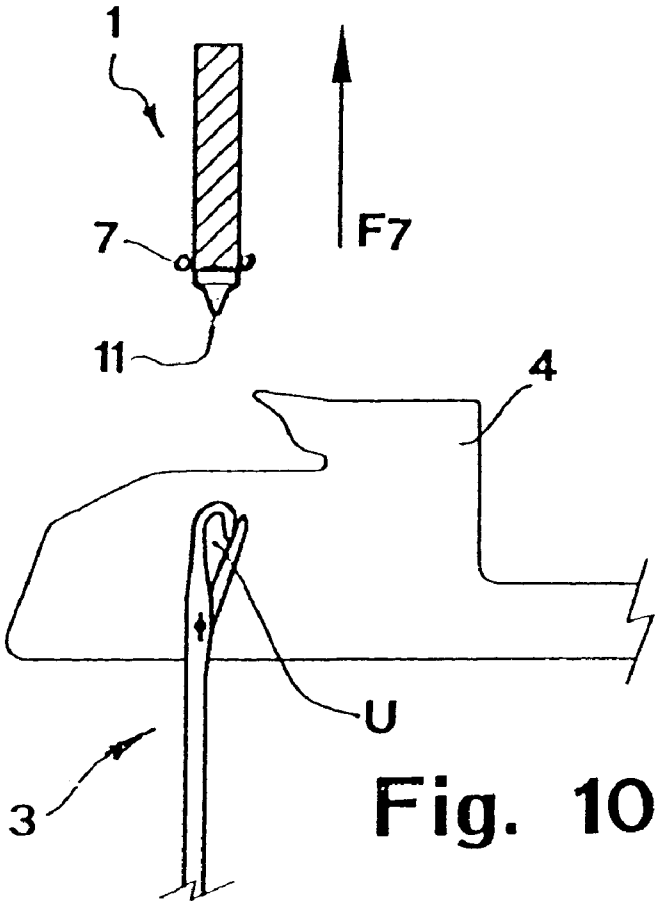
Figure 9:
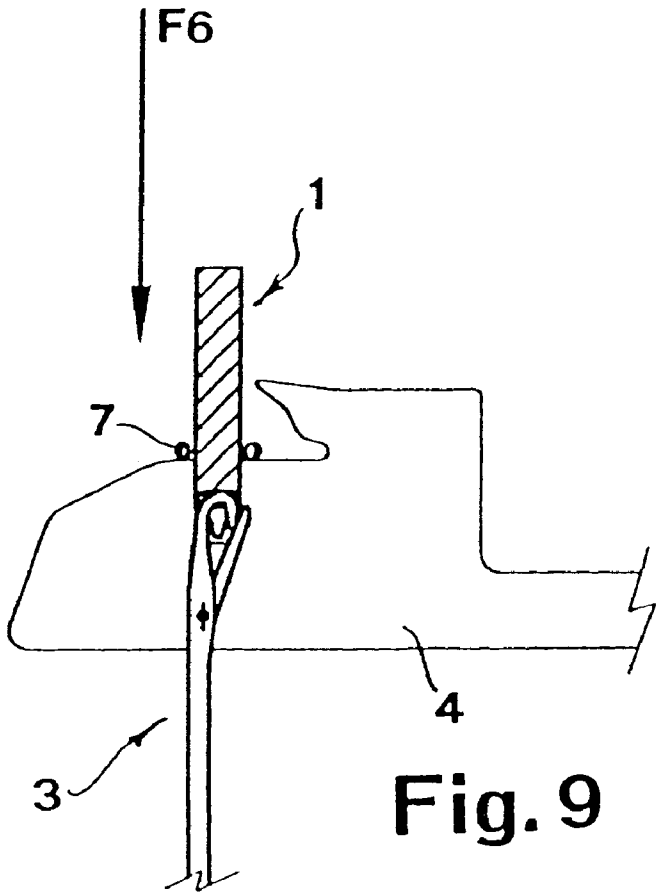
Figures 11A, 11B:
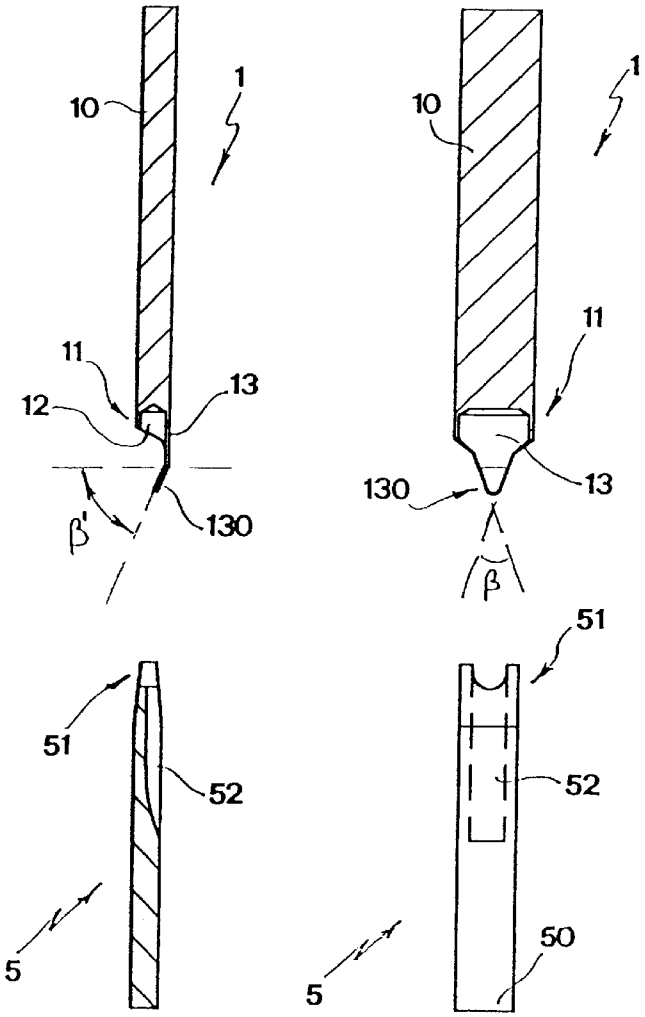
FIGS. 11A and 11B are a section and front view of a pusher and a stitch transfer member in disengaged condition in an apparatus according to the invention.
Figure 12B:
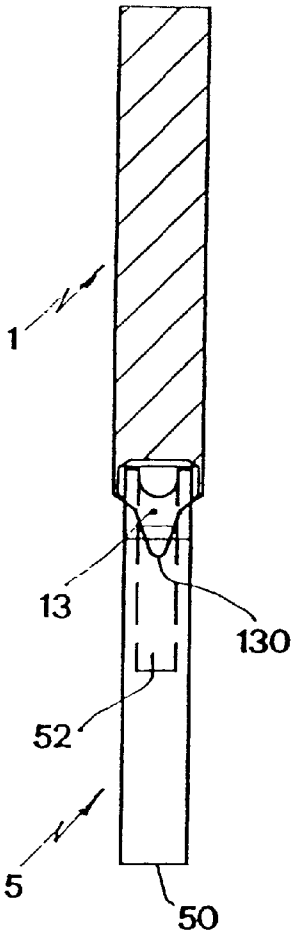
FIGS. 12A and 12B are members of FIGS. 11A and 11B, viewed as in the latter figures, in engaged condition, that is, in a condition suitable for the transfer of stitches in both directions.
Figure 12A:
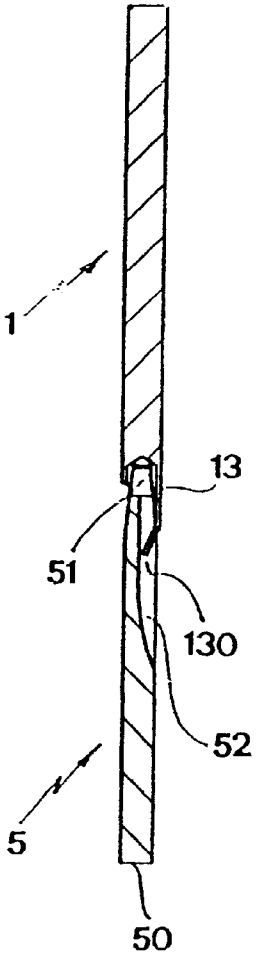
Figure 13A:
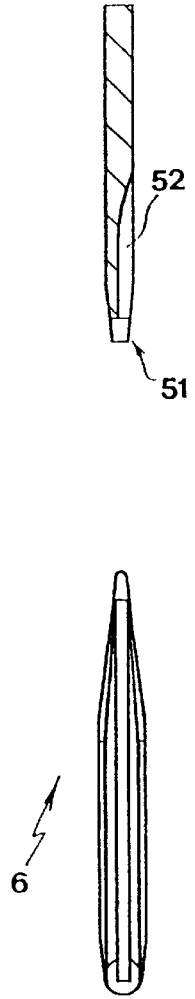
FIGS. 13A and 13B show a hook-up spike and a transfer member, in front view and side view, in disengaged condition.
Figure 13B:
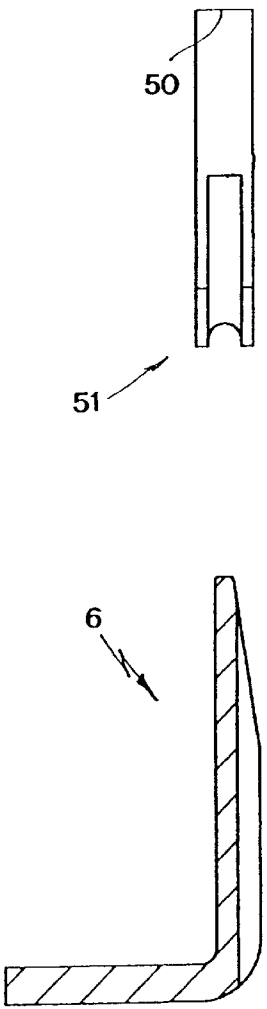
Figure 14A:
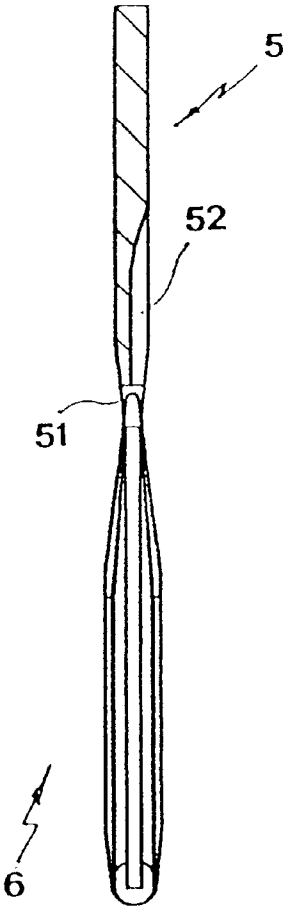
FIGS. 14A and 14B show the members of FIGS. 13A and 13B, in engaged conditionas in the latter figures.
Figure 14B:
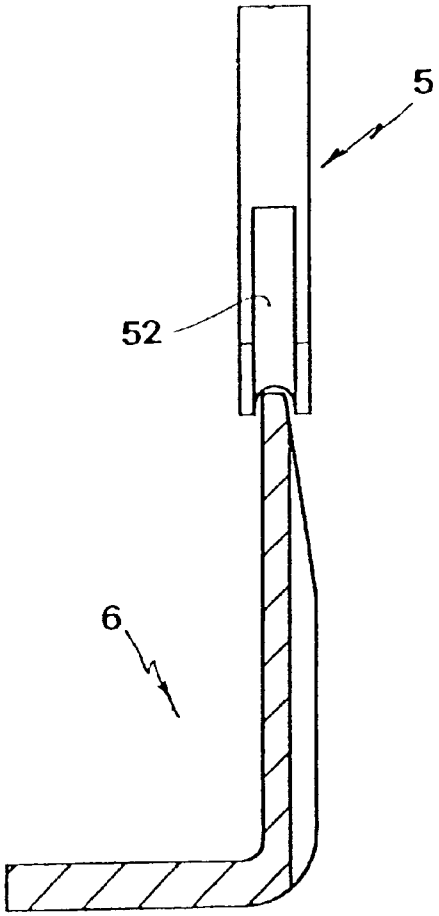
Figure 15B:
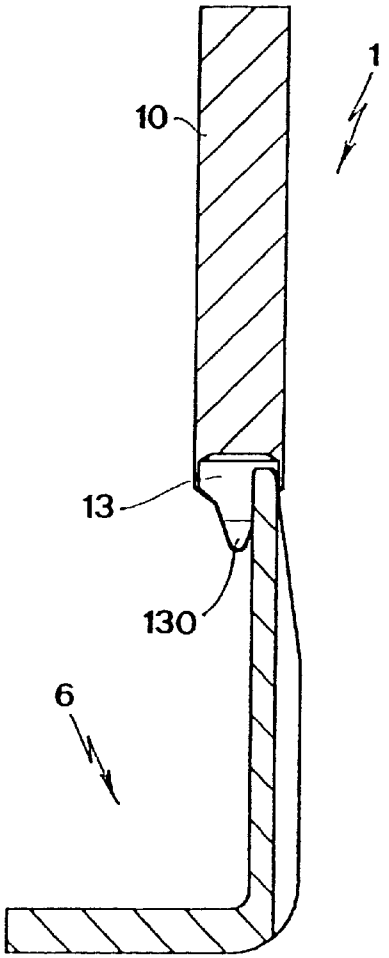
FIGS. 15A and 15B show a pusher and a hook-up spike, in front view and side view, in engaged condition.
Figure 15A:
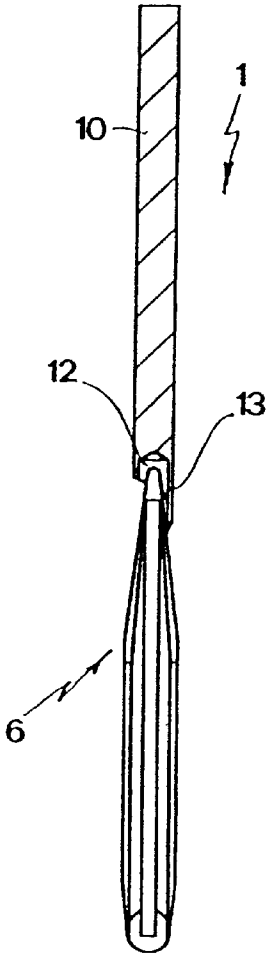

By moving a thus shaped pusher (1) close to the head of a needle of any type—as illustrated, for example, in FIGS. 1–10—so that the end (130) of appendix (13) be located inwardly of the area (A) subtended by the respective crook (U), without projecting laterally, there is obtained the said covering condition. The stitch (7) already fitted on the needle (2; 3) is in fact free to slide along the axis of the latter until it result unloaded, that is, no longer engaged by the needle whose latch (30) or bearded part (20) or slide will be disposed in closed condition. In case of bearded needles (2), the closing condition is determined by the intervention of a rod (200) suitably controlled to achieve the bending and pushing thereof (FIGS. 2 and 3). In case of needles (3) of latch type, the said closing condition is determined by the movement of stitches (7) on respective needles (3) subsequent to the lowering thereof, according to procedures well known to those skilled in the art (FIGS. 7 and 8). For the sake of simplicity, the representation of the slide needles is omitted in the attached drawings. In any case, by proceeding in the way set forth above, there is obtained a covering condition which is also related to the pusher (1), as the respective most forward end (130) results inside the eye of the needle's crook. As a result, the stitch (7) in question, before being fully unloaded from the respective needle, that is, before leaving it altogether, result already fitted on the pusher. The wedge-like configuration of the appendix (13) of pusher (1) determine, where necessary, a gradual elastic expansion of the stitch (7) involved in the changeover. Moreover, owing to the fact that the end portion (130) of pusher (1) is inclined at an angle with seat (12), that is, with the needle, the expansion of the stitch upon said changeover takes place progressively without inducing any sudden tensioning of the thread which the stitch is made of. It will be appreciated that the opening angle (B) of wedge (13) and the angle (B') of inclination of the end portion (130) of pushers (1) are properly selected in relation to the geometric and dimensional characteristics of the needles (2; 3) with which they are to interact with.

Figure 1:
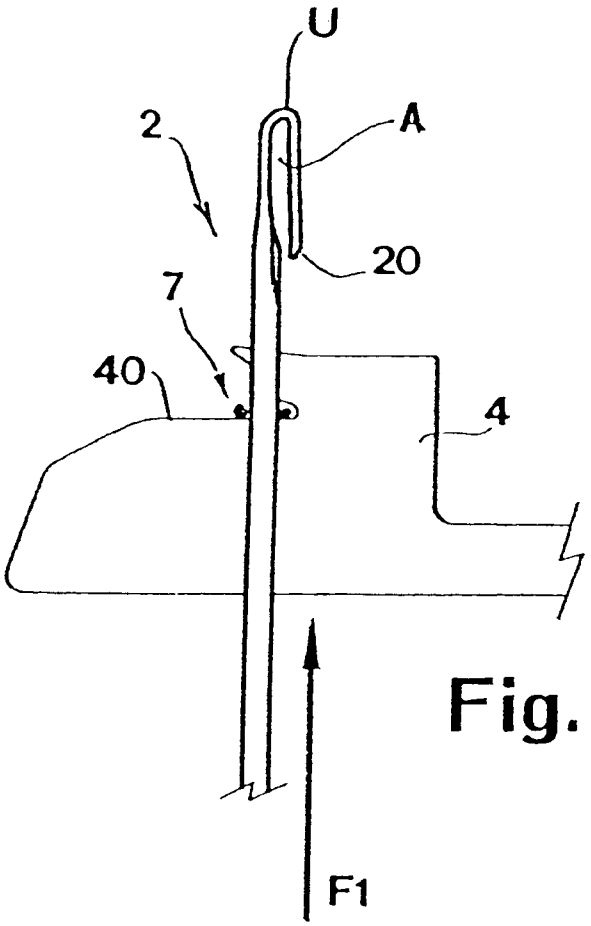
Figure 5:
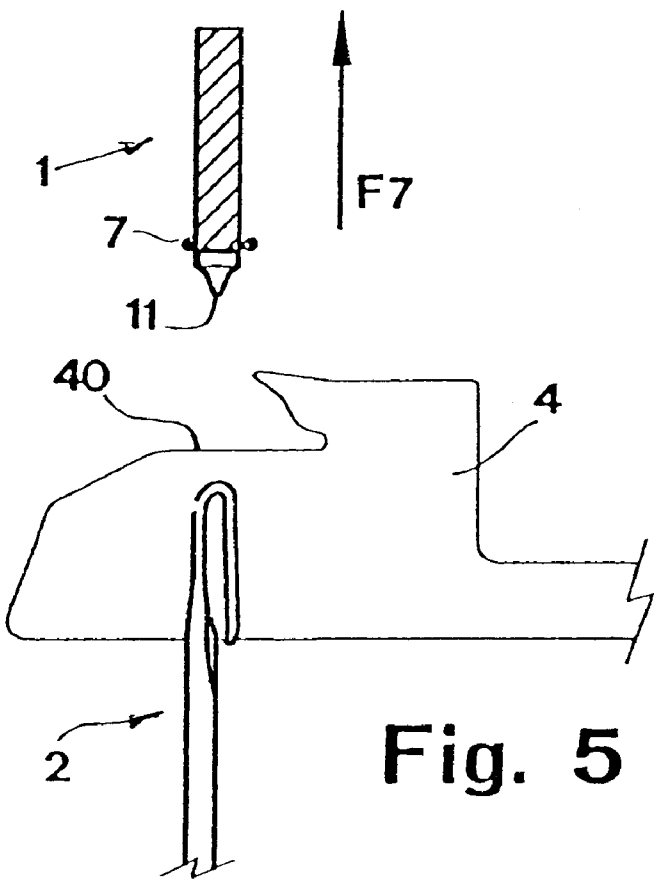
Figure 4:
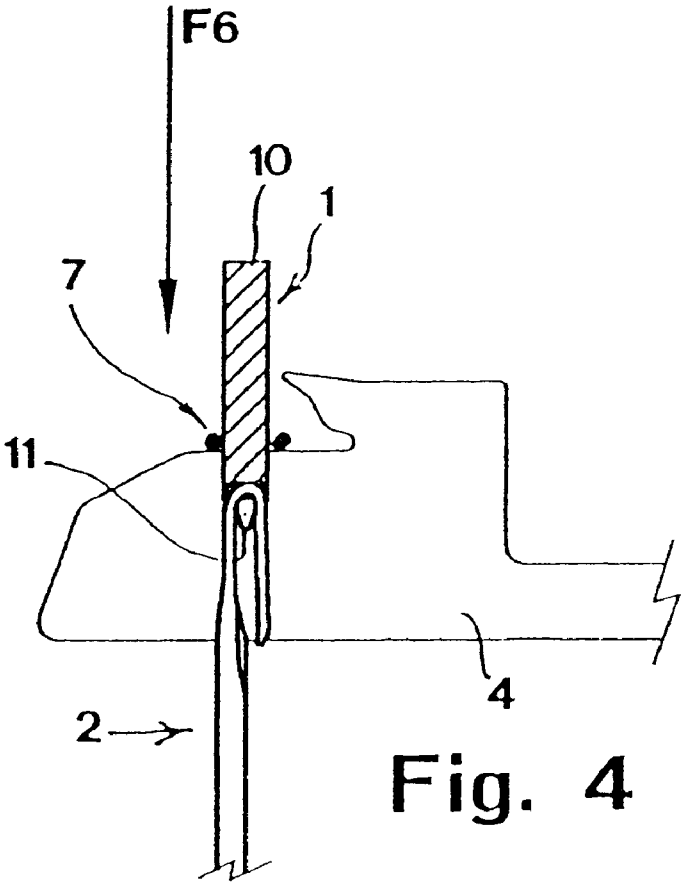

Described herebelow with reference of FIGS. 1–5 is a possible way of application of the apparatus according to the invention for the removal of stitches (7) from a knitting machine provided with needles of beak type and movable sinkers (4) with the cast-off or stitch plane (40) solid thereon. Upon completion of knitting of the article, each needle (2) is lifted at least up to the level of unloaded condition (that is, to such a level that the stitch fitted on the needle will result positioned below the lower end of the beak or bearded part), as indicated by the arrow "F1" (FIG. 1). Thereafter, the sinkers (4) are moved back and the relevant needles lowered down to a preset level and such, anyway, that the respective stitches will not come back within the corresponding, still open crooks (U), as indicated by the arrows "F2" and "F3" (FIG. 2). Each pusher (1) is then moved close to the corresponding needle (2), as indicated by the arrow "F4", so that the needle head will result be seated within the cavity (12) of the pusher (1), and provision is made for closing the needle crook by means of the respective rod (200) driven as indicated by the arrow "F5" (FIG. 3). At this point, each needle-pusher group is lowered, as indicated by the arrow "F6", so that the stitch plane (40) of the respective sinker (4) will prevent the stich (7) from lowering and allow it to move onto the stem (10) of pusher (1) which the stitch adheres to by its own elasticity (FIG. 4). Now, each pusher (1) may be moved away from the respective needle (2), as indicated by the arrow "F7", to take the thus removed stitch (7) to other processing members (FIG. 5).

In case of a knitting machine provided with needles (3) of latch type, the sequence of operations illustrated in FIGS. 6–10 of the drawings corresponds exactly to that illustrated with reference to FIGS. 1–5, save that, in this case, the closing of the crook of needles (3) does not imply the intervention of the rod (200). In FIGS. 6–10, references F1, F2, F3, F4, F6 and F7 have the same meaning as in FIGS. 1–5.

An apparatus according to the invention may also comprise means with one or more members (5), herein defined as "transfer members", able to accomodate one or more corresponding stitches (7) already fitted on said pushers (1) and operate the transfer thereof onto other handling or treatment means. The whole of the transfer members (5), necessary for gathering a given number of stitches (7) from an equal number of pusher (1), defines a front whose shape and disposition match those of the front of pushers (1) with which they are made to interact. With reference to the embodiments illustrated by way of example in the figures of the attached drawings, each of said transfer members is made up of a body (5) with a stem (50) terminating with a free end portion (51) of a shape and dimensions corresponding to those of seat (12) formed in the free end portion (11) of pushers (1), so that, under the operating condition of pushers/transfer members engagement, the free end (51) of each transfer member (5) will be able to fit into the seat (12) of the corresponding pusher (1). This end (51) of transfer members (5) may be of wedge-like shape and suitably tapered at the vertex (as in the exmples of FIGS. 11A–11B, 19A–22B, 26A and 26B) in order to ease said engagement by which the stitches move from the pushers (1) to the transfer members (5) without obstacles likewise in the above described needles/pushers engagement. To achieve this covering condition, it is sufficient to move each transfer member (5) close to the corresponding pusher (1) so that the respective free ends (11, 51) will be sufficiently close and in face-to-face relationship.

It will be appreciated that in order to obtain the desired engagement, the end (51) of body (5) need not be of a shape exctly like that of the seat (12) of pushers (1), but it is sufficient that it will be able to fit thereinto without difficulty.

Advantageously, according to the invention, one or more transfer members (5) above indicated may exhibit a lateral slot (52), especially on the side which, upon the engagement thereof with the respective pushers (1), is made to face the appendix (13) of the latter, the depth of this slot (52) being so selected as to be able to fully accomodate the end portion (130) of said appendix (13). In this way, the previously defined covering condition is bidirectional, meaning that the stitch is allowed to move without obstacles from the pusher to the transfer member and vice versa. Accordingly, one or more stitches already laid down onto corresponding transfer members (5) may be subsequently removed therefrom by the same pushers they came from, or by other pushers (1).

Figure 16B:
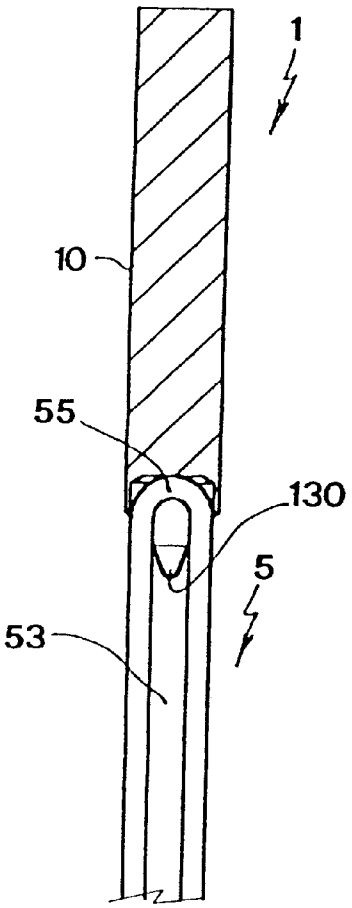
FIGS. 16A and 16B show schematically the direct engagement between a pusher and a transfer member made of U-bent wire, in engaged condition, that is, in a condition suitable for transferring stitches in both directions.
Figure 16A:
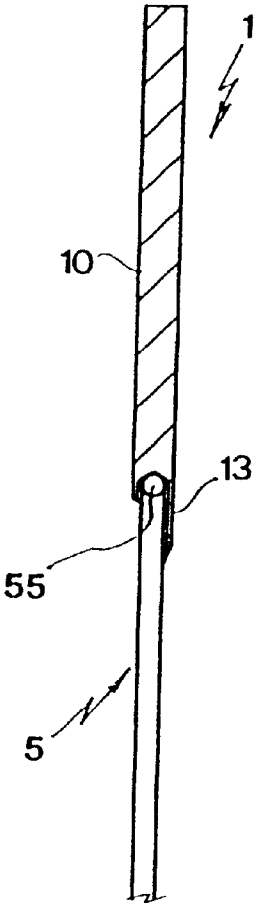
Figure 24B:
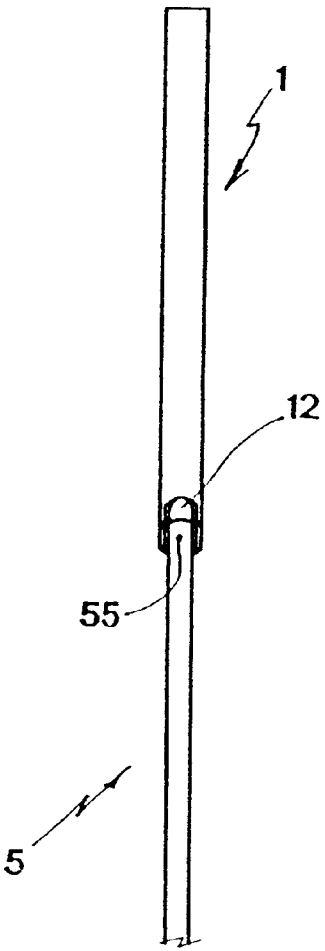
FIGS. 24A and 24B show schematically the direct engagement between a pusher and a transfer member made of U-bent wire.
Figure 24A:
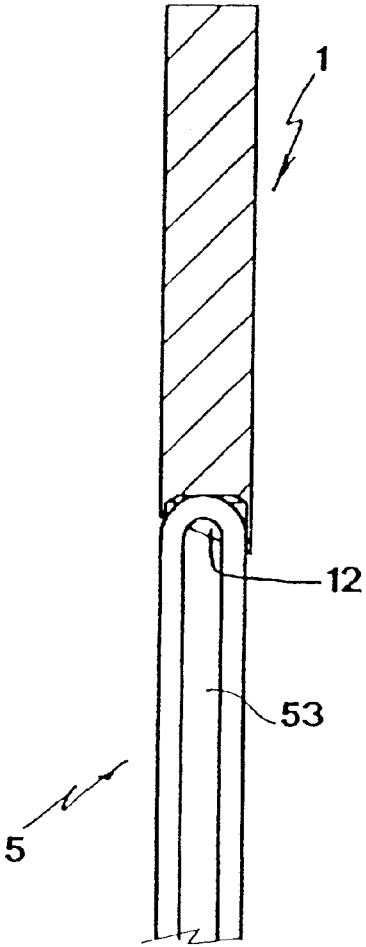
Figure 28B:
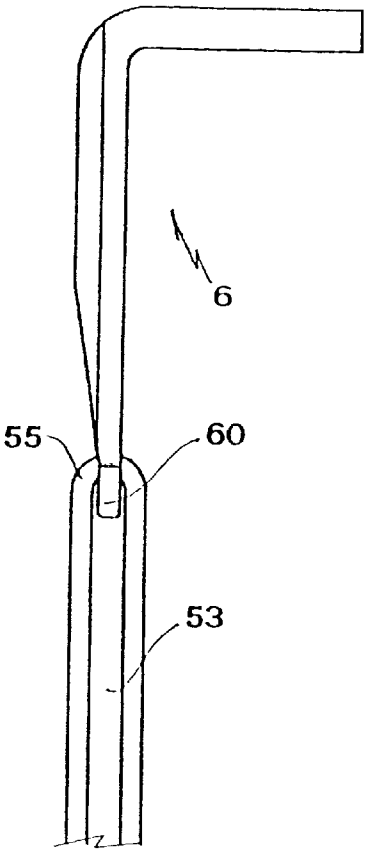
FIGS. 28A and 28B show schematically the engagement between a hook-up spike modified according to the invention, and U-shaped transfer member in side and front sectional view.
Figure 28A:
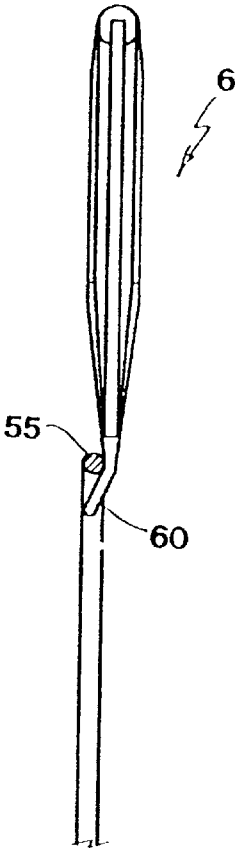
Figure 27B:
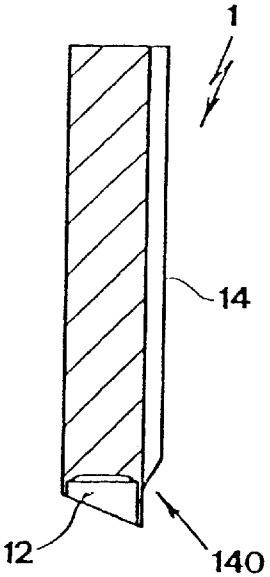
FIGS. 27A and 27B show a pusher of an apparatus according to the invention, in a further embodiment thereof, in side and front sectional view.
Figure 27A:
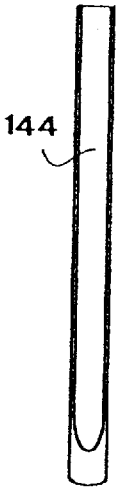
Figure 29:
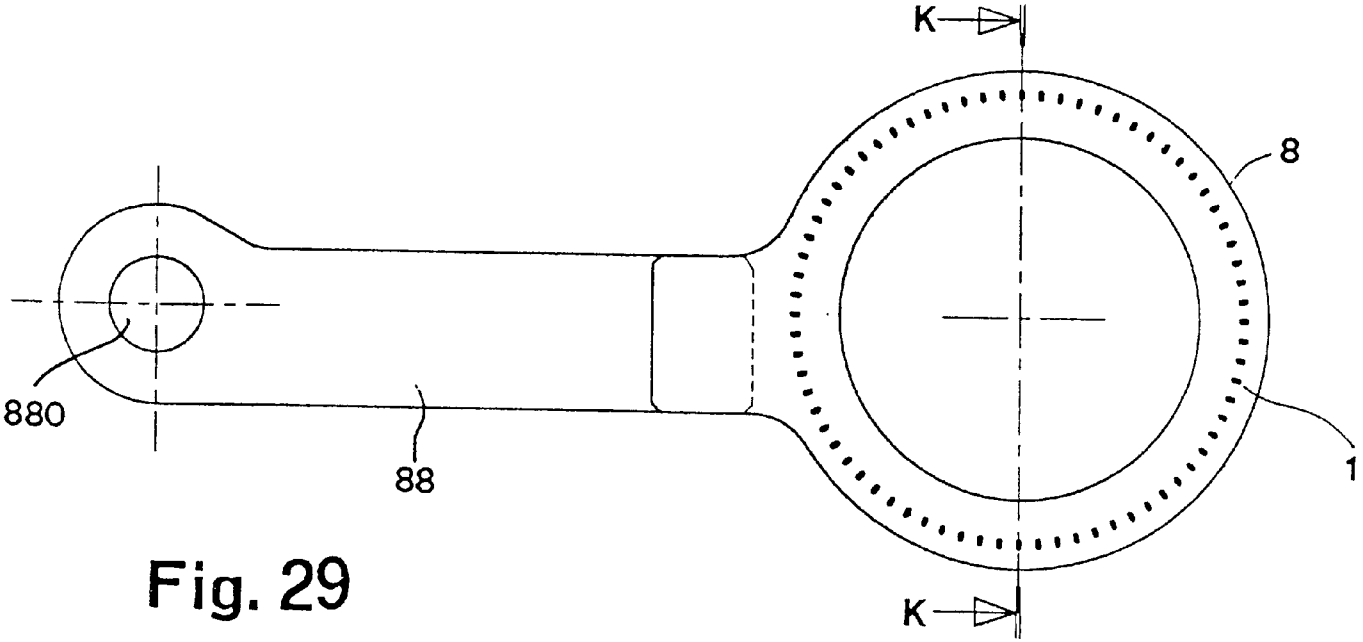
FIG. 29 shows a support for pushers according to the invention.
Figure 30:
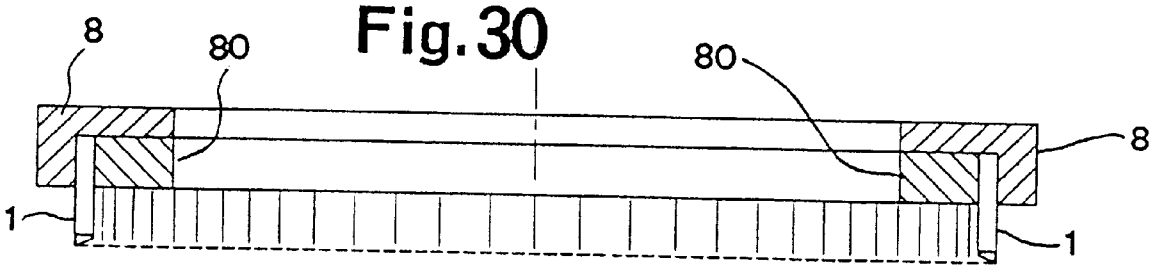
FIG. 30 is an enlarged sectional view taken on line K—K of FIG. 29.
Figure 31:
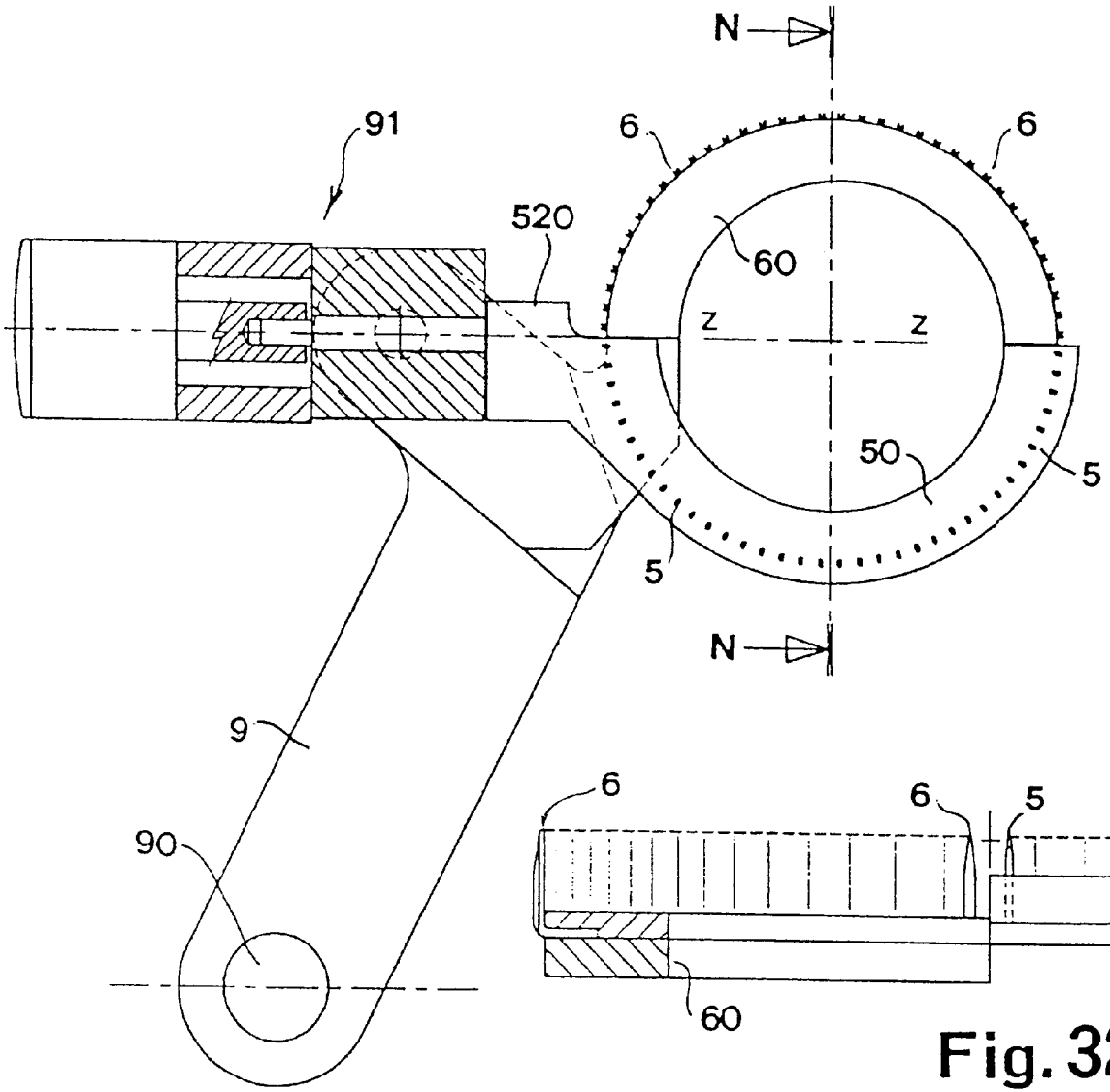
FIG. 31 shows a support for transfer members and spikes, according to the invention.
Figure 32:
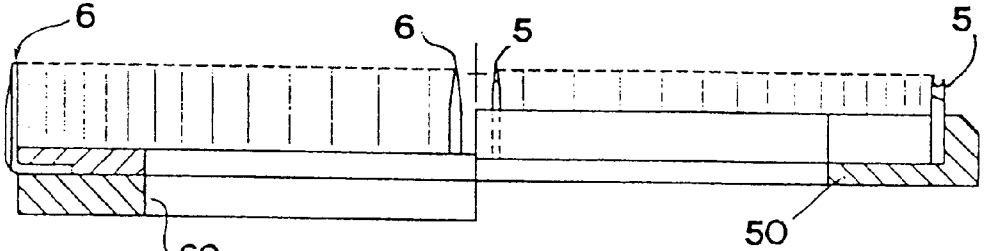
FIG. 32 is an enlarged sectional view taken on line N—N of FIG. 31.

To improve the operating capability of the transfer member (5), according to the invention, provision is suitably made for giving the head portion (51) of the same transfer member a concave cross-section (see FIGS. 11B, 13B, 19A, 20A, 21A, 22A and 26B) with its concavity facing the member which the stitches will be either laid on, or removed from. According to a further embodiment, the transfer members may consist, as illustrated by way of example in FIGS. 16B, 24A and 28B, of a body (5) with a longitudinal slit (53) which makes it possible to move the stitches from the same transfer members to support members for carrying out such operations as the hooking-up. Illustrated in FIGS. 28A and 28B is the case of a thus made transfer member (5) intercating with hook-up spike (6) whose free end (60) is suitably shaped, expecially bent, to fit into the slit (53) of a transfer member (53) before the stitch moves from the transfer member (5) to the spike (6). This result can be achieved in an extremely simple way by having the transfer member (5) made up of a U-bent filiform body with the apex (55), in enegagement condition, that faces the body to intercat with. A transfer member having such construction is able to interact not only with members such as the spikes of a hooking-up machine, but also with the above described pushers (1) by causing the apex (55) of transfer member (5) to fit into the seat (12) of the pusher illustrated in FIGS. 16A and 16B—the thus obtained covering condition being of bidirectional character. In any case, as illustrated in FIGS. 24A and 24B, said transfer member (5) may be used also in association with a pusher (1) lacking of the apex sideways of seat (12), in order to achieve only a unidirectional covering condition upon the stitch movement from the pusher to the transfer member. A possible way of using an apparatus provided with this type of transfer member consists in fitting thereon more stitches belonging to different articles and to be removed in a group, so that a number of stiches belonging to different articles may be laid down on each pusher and be transferred onto the front of a textile machine for keeping on the knitting of a composite article.

A pusher (1) according to the invention may also interact directly with a hook-up spike (6) shaped as above described, so as to exhibit an end portion (60) ending up with an apex advantageously bent inwardly.

Figures 17A, 17B, 18:
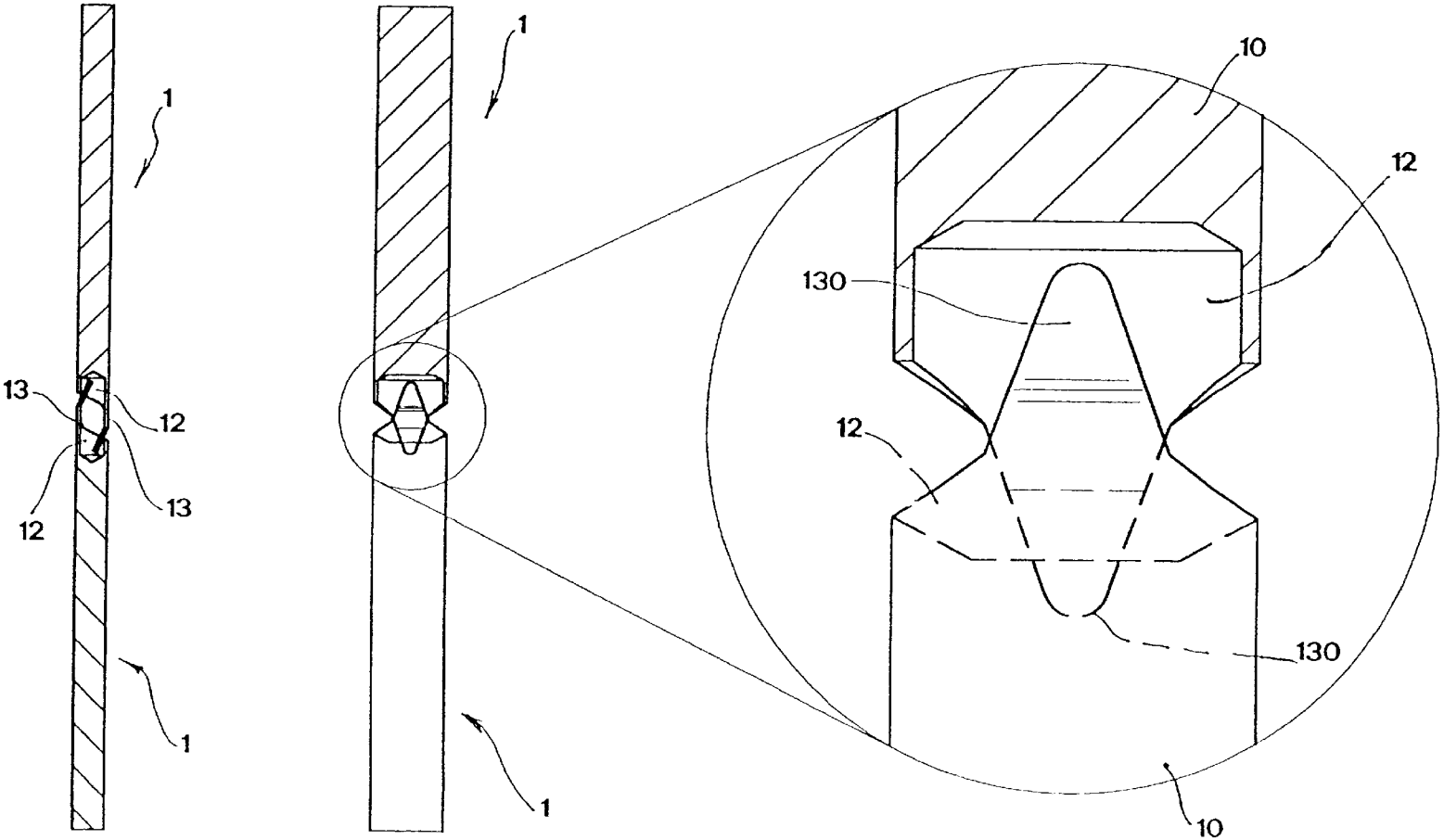
FIGS. 17A and 17B show schematically a direct engagement between like pushers, in sectional side and front views.
FIG. 18 shows an enlarged detail of FIG. 17B.
Figure 19B:
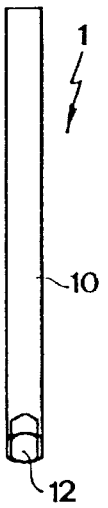
FIGS. 19A and 19B show a pusher of known type, and a transfer member of an apparatus according to the invention, in sectional front and side views, in disengaged condition.
Figure 19B:
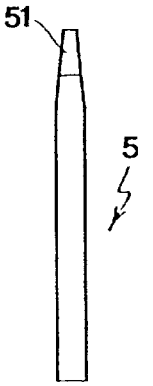
Figure 19A:
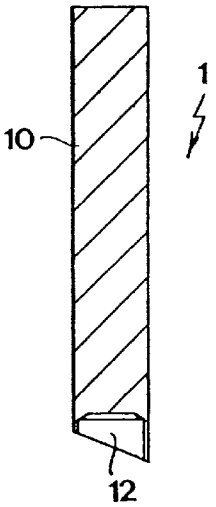
Figure 19A:
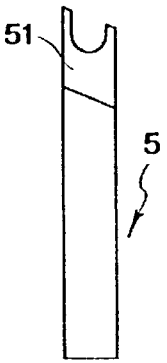
Figure 20B:
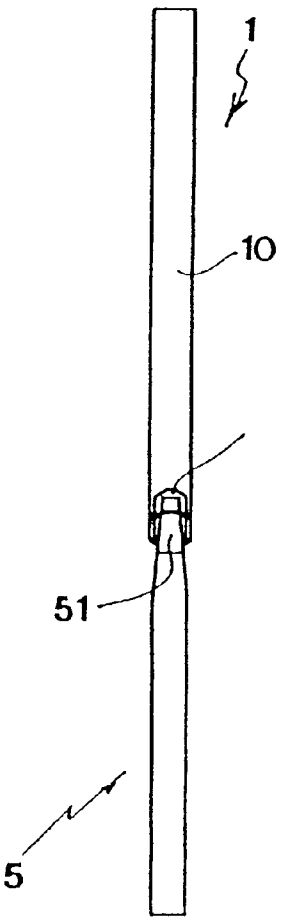
FIGS. 20A and 20B show the members of FIGS. 19A and 19B, in engaged conditionas in the latter figures.
Figure 20A:
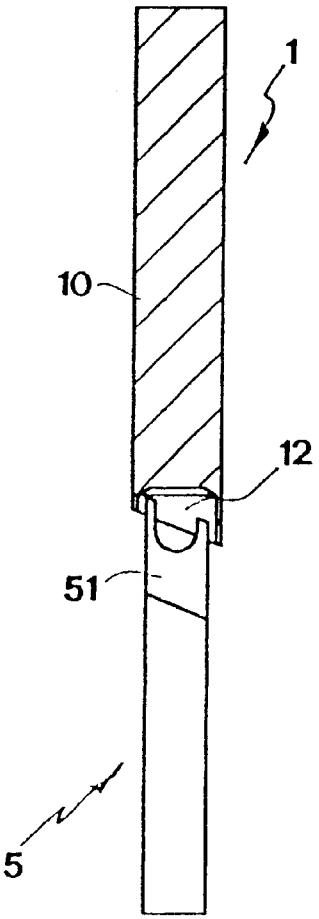

Moreover, as illustrated in FIGS. 17–18 of the attached drawings, the transfer of the stitches may also take place between two pushers (1) which, under engagement condition, will be brought close to each other in face-to-face relationship so that the free end (130) of each one of them will be received in the seat (12) of the other.

A pusher (1) according to the invention may also exhibit, as can be seen in FIGS. 25A, 25B, 25C, 27A and 27B, two parallel fins (14) longitudinally developing on one side of pusher (1) and radiused to the pusher body in correspondence of the end (140) facing the free end (13) thereof, said fins being able to delimite a corresponding side slot (144) able to receive the needle of a hooking-up machine. A thus shaped member nakes it possible, for example, either to hook-up the edge of an article—removed from the textile machine that has made it—directly on the pushers which have carried out the removal, or to join, again by a hooking-up operation performed directly on the pushers, different edges of one or more articles knitted over one or more machines and removed by the same pushers.

Figure 26B:
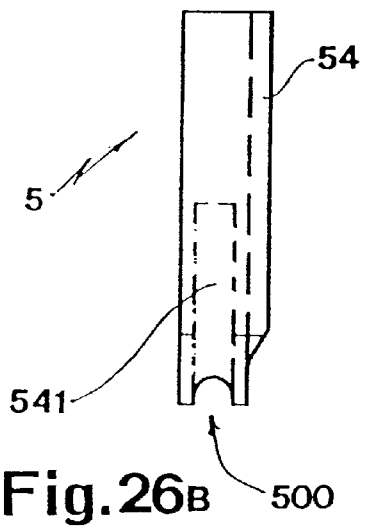
FIGS. 26A, 26B and 26C show a transfer member in side, front and cross-sectional view, according to a further embodiment.
Figure 26C:
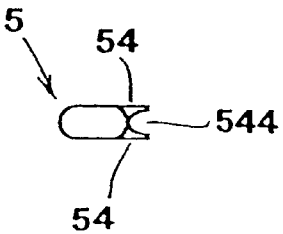
Figure 26A:
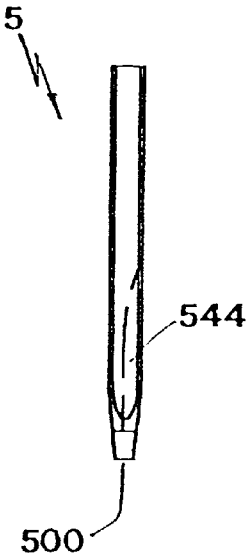
Figure 25B:
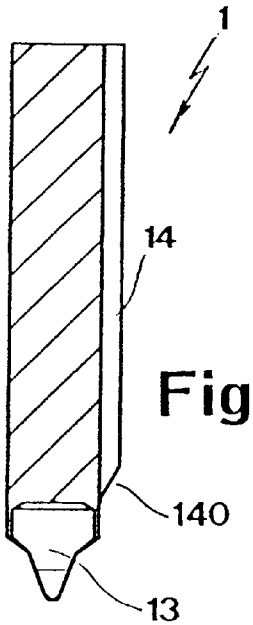
FIGS. 25A, 25B and 25C show a pusher in side, front and cross-sectional view, according to a further embodiment.
Figure 25C:
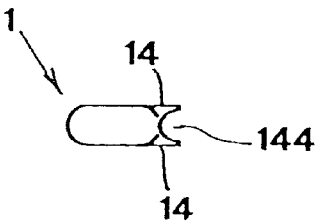
Figure 25A:
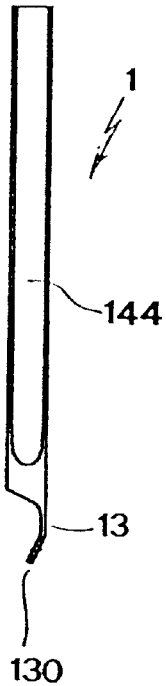

According to the invention, also the transfer members (5) may be provided with two parallel fins (54) longitudinally developing on one side of pusher (1) and radiused to the respective body in proximity of the end (500) thereof, so as to delimite a corresponding side slot (544) able to receive the needle of a hooking-up machine (FIGS. 26A–26C).

Figure 21B:
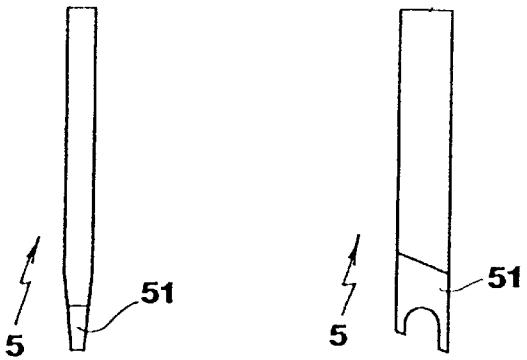
FIGS. 21A and 21B are schematic representations like those in FIGS. 13A and 13B, with a transfer member according to a further embodiment.
Figure 21A:
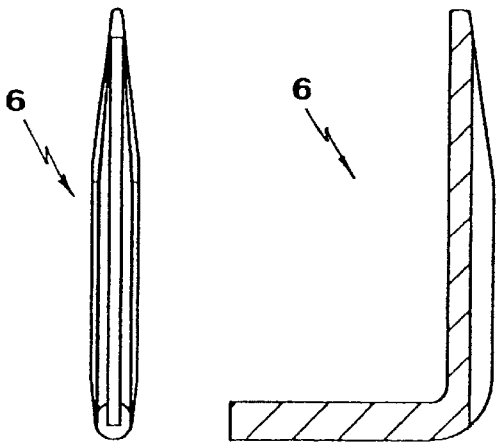
Figures 22A, 22B:
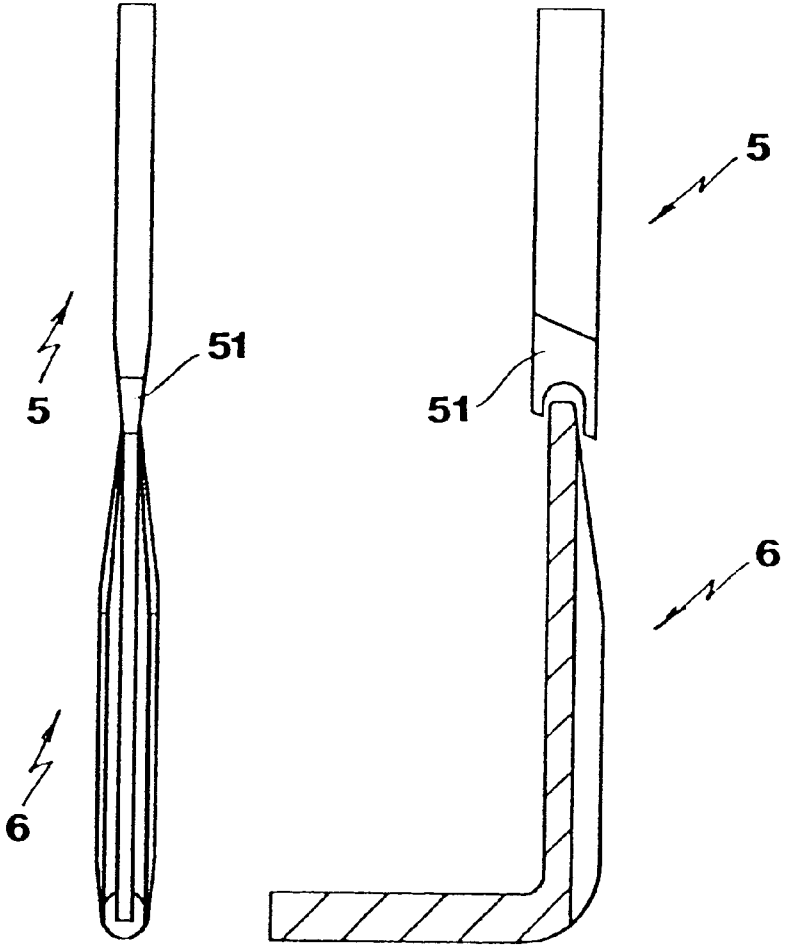
FIGS. 22A and 22B show schematically the members of FIGS. 21A and 21B in engaged condition as in the latter figures.
Figure 23B:
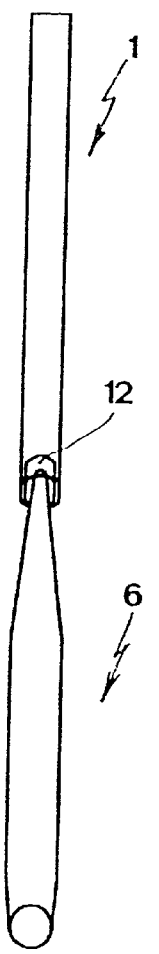
FIGS. 23*a* and 23*b* show schematically the pusher and hook-up spike.
Figure 23A:
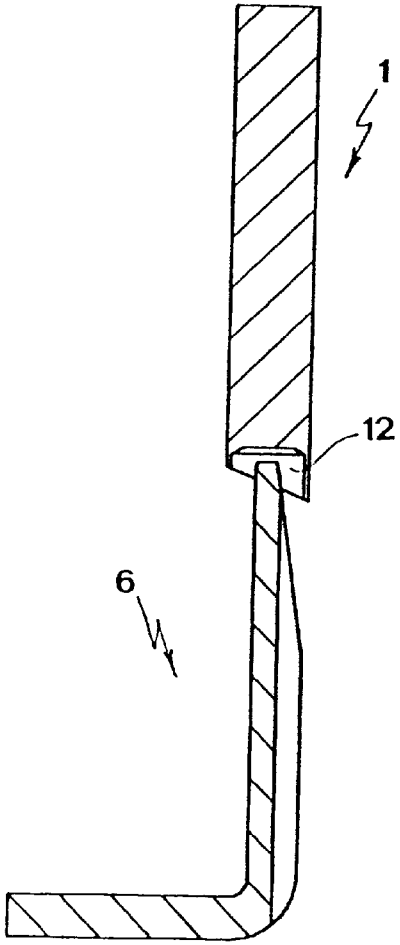

All this makes it possible to have a same member perform more operating functions: the pusher having possibly the function of removing or driving the stitches as well as supporting them during the hooking-up step and, likewise, the transfer members possibly serving both for driving the stitches removed from the pushers and for supporting them upon the hooking-up. More particularly:

the pushers of FIGS. 19A, 19B, 24A and 24B are able to remove the stitches from latch and slide needles and lay them down onto latch, slide and beak needles, in any type of transfer member (5), according to the invention, as well as onto the spikes (6) of FIGS. 14A, 14B, 28A and 28B;

the pushers (1) according to the invention, that is, pushers provided with appenidx (13) located sideway of seat (12), are able to remove/lay down stitches from/onto knitting needles of any type, from/onto all the transfer members (5) according to the invention, and to interact with pushers (1) of the same type and lay down stitches onto any type of hook-up spike;

the U-shaped transfer members are able to receive the stitches from pushers (1) provided or not with appendix (13) and hand on the stitches to spikes (6) of the type illustrated in FIGS. 28A and 28B and to pushers (1) provided with appendix (13):

the transfer members (5) of FIGS. 11A, 11B, 13A and 13B are able to receive the stitches from the pushers (1) of FIGS. 11A, 11B, 19A, 19B, 25A–25C, 27A and 27B, and hand on the same stitches to the pushers (1) of FIGS. 11A, 11B, 25A and 25B, as well as to the spikes (6) with end (60) bent or not;

the trasnfer members (5) of FIGS. 21A and 21B are able to receive the stitches from pushers (1) and hand them on to spikes (6) having their end (60) bent or not;

the transfer members (1) with side slot (144) of the type illustrated in FIGS. 25A–25C, 27A and 27B, as well as the transfer members (5) with side slot of FIGS. 26A–26C, may also have the function of hook-up spikes;

the spikes (6) with bent end (60) of the type illustrated in FIGS. 28A and 28B, are able to receive the stitches from all the pushers (1), from all the transfer members (5) above described and from any type of knitting needle;

the spikes (6) with straight, that is, not bent end portion, are able to receive the stitches from any type of pushers (1) and transfer members (5) for the U-type transfer of FIGS. 28A and 28B.

As far as the support and driving means of said pushers (1) and transfer members (5) according to a possible embodiment thereof are concerned, they comprise a stiff body on which the pushers (1) respectively the transfer members (5) are fixed to move these members by driving into motion their respective supports: said supports being associated to corresponding driving means through one or more electrical or pneumatic actuators. The pushers (1) and the transfer members (5) will thus be disposed on respective supports to take up, as a whole, a profile of predetermined shape and substantially corresponding to that of the knitting needles assembly. For example, if the front of the knitting machine is circular, straight or mixed, the pushers (1) and transfer members (5) will be disposed so as to take up a circular, straight or mixed profile. The pushers (1) and the transfer members (5) may also be housed, with one or more degrees of freedom, upon the respective supports in order to be operated either individually or in groups—each group consisting of a preset number of units—also regardless of the respective supports. To drive into motion the pushers and transfer members seated in the corresponding supports, cam means may be provided acting upon heels projecting from the same pushers (1) and transfer members (5). The support for the pushers and transfer members may also consist of a body able to take up under control different shapes and adapt itself to the fronts of the knitting machines being associated each time therewith. This result can be achieved, for example, by providing a support made up of a plurality of rigid bodies linked by hinges. All this allows, for example, terminal stitches of articles produced on a circular machine to be removed and laid down onto needles of a straight machine, or vice versa, to then continue the knitting according to procedures other than the initial ones.

Described herebelow by way of example and with reference to FIGS. 29–35 of the attached drawings, are feasible embodiments of supports for pushers (1), transfer members (5) and spikes (6), according to the invention.

The said pushers (1) can be fixed to a support with two circular concentric crowns (8, 80), between the facing edges of which the pushers (1) are inserted, the support being provided at one end with an arm (88) whose opposite end exhibits a hole (880) allowing the same arm to be fitted on a column (87) able to move the arm (88) together with support (8, 80) between a station, where a circular knit machine operates and from the needles (2, 3) of which the stitches (7) can be removed, and another station, where a hooking-up machine is provided for hooking-up the article whose stitches (7) of the last knitted rank have been placed onto transfer members (5) and onto spikes (6), as indicated later on. The transfer members (5) and spikes (6) can possibly be fixed to corresponding complementary semicrowns (50, 60) provided at one end of a corresponding driving arm (9), the said arm (9) being provided at the other end with a hole (90) for fitting the same arm idly on said column (87). The semicrown of transfer members (5) is connected through its appendix (520) to rotary actuator (91) fixed to said arm (9) to allow the overturning, that is, the rotation through 180° thereof about a diametral axis (Z—Z), so as to make the free end of each trasfer member (5) come in contact with a corresponding spike (6) in a controllable way. Shown in FIGS. 31 and 32 respectively in FIGS. 33 and 34, are the supports (50, 60) of tranfer members and spikes before and respectively after said overturning.

The above mentioned supports allow, for example, the removal of stitches of the last rank knitted on needles of a circular machine, by means of pushers (1) suitably disposed on said needles by the arm (88) to which the crown (8) bearing the same pushers is fixed. Afterwards, the said supports allow transferring the stitches of the first semirank (the last rank of stitches that can be virtually subdivided into a first and second semiranks) from respective pushers (1) to trasnfer members (5), and those of the second semirank from respective pushers (1) to the spike (6). By overturning the semicrown support (50) over the semicrown support (60), the stitches of first and second semiranks will result associated in pairs, that is, disposed in a manner suitable for being hooked-up by means of a hooking-up machine. If the stitches removed by the pushers (1) are those of the last knitted rank of a stocking manufactured starting from the edge or hem and finishing with the knitting of the left-open toe, the operation cycle above described corresponds to the hooking-up of the stoking toe.

The said column (87) may be in two coaxial elements to each of which a corresponding arm (88, 9) can be fixed in order to independently drive the said elements into motion. Alternatively, said arms (88, 9) may be fitted on a same column element and associated to separate driving members.

Figure 33:
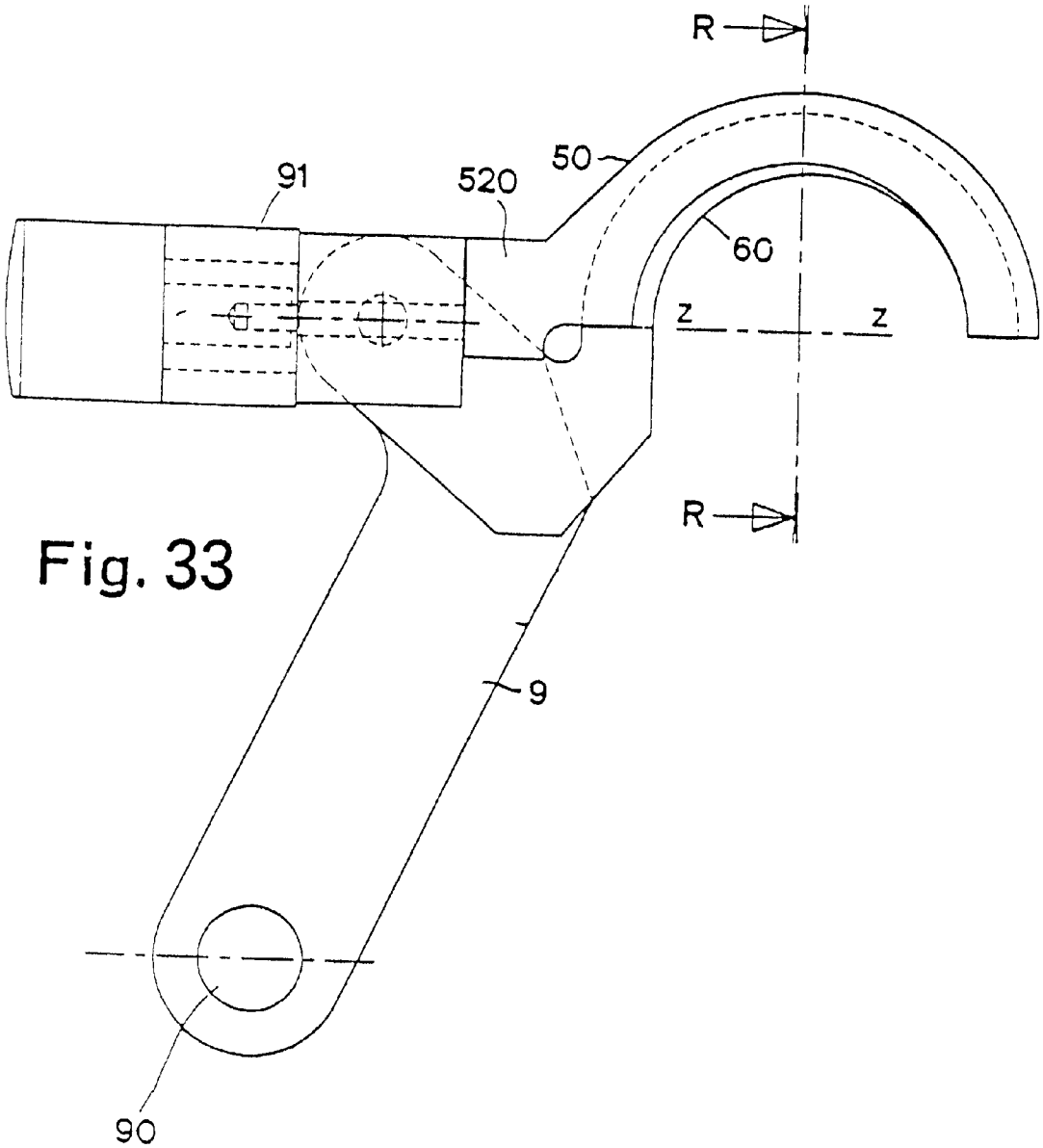
FIG. 33 show the means of FIG. 31 with the transfer members' semicrown overturned through 180°.
Figure 34:
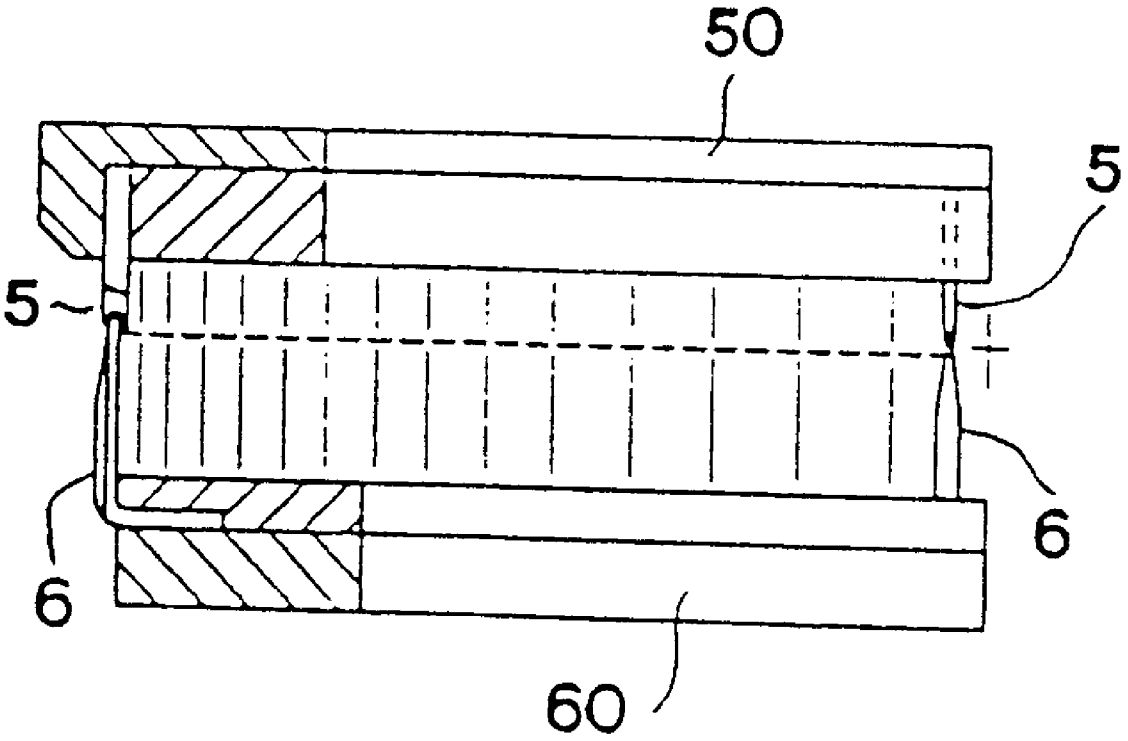
FIG. 34 is an enlarged sectional view taken on line R—R of FIG. 33.
Figure 35:
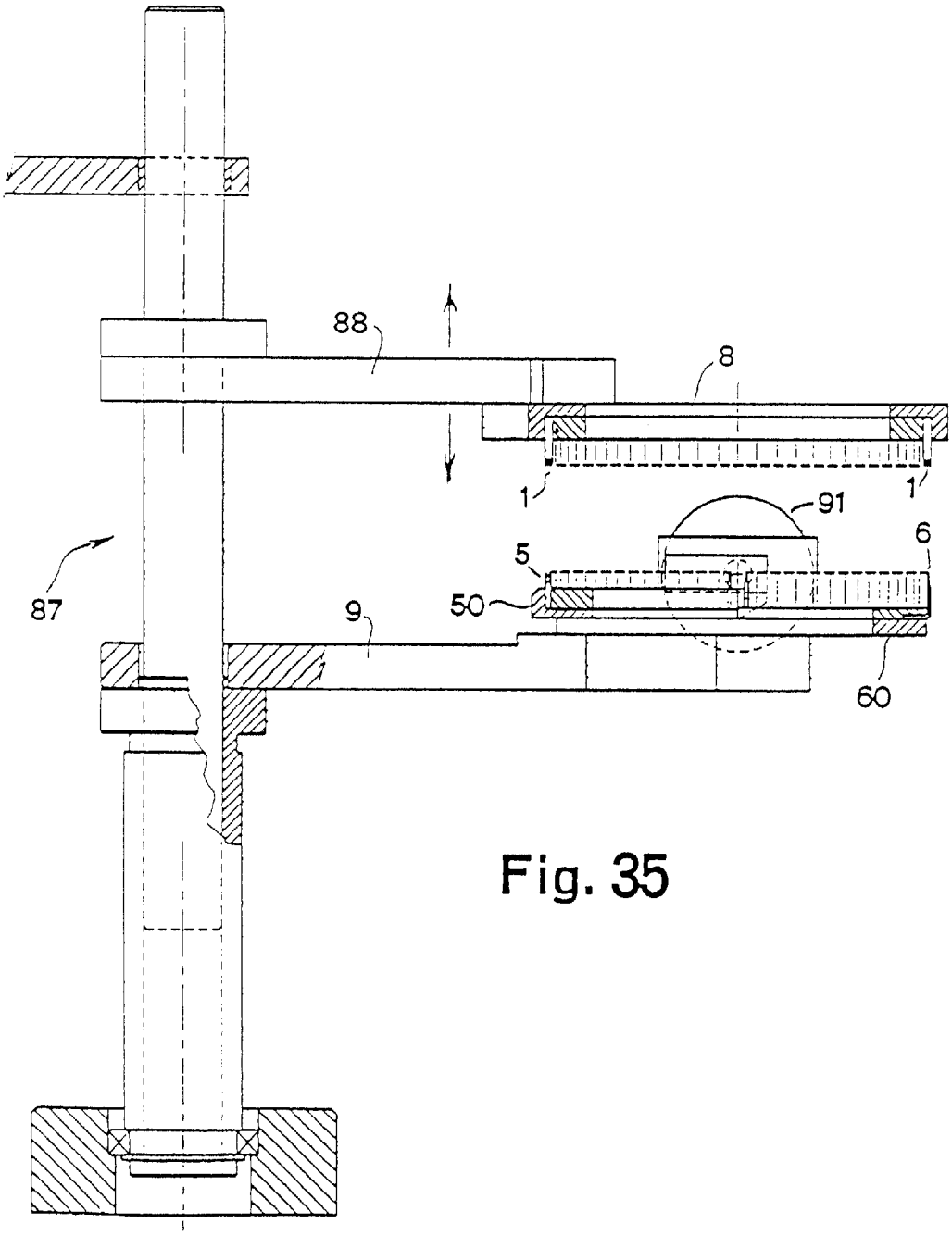
FIG. 35 shows the column bearing the said supports.
Figure 37:
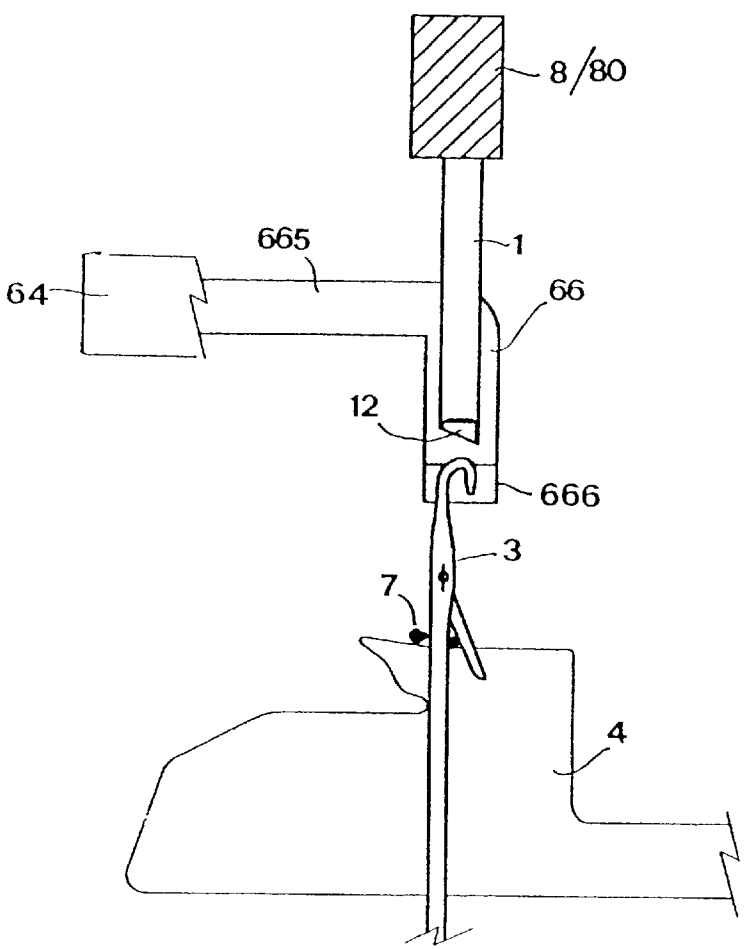
FIGS. 36–39 show schematically the means for guiding the needles toward the seats of their relevant heads, according to a feasible embodiment.
Figure 36:
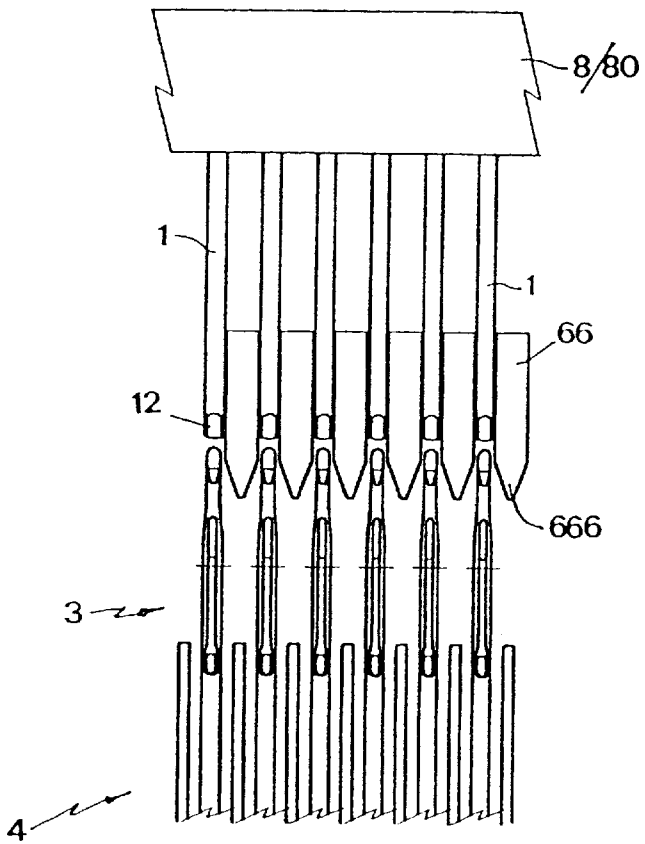
Figure 38:
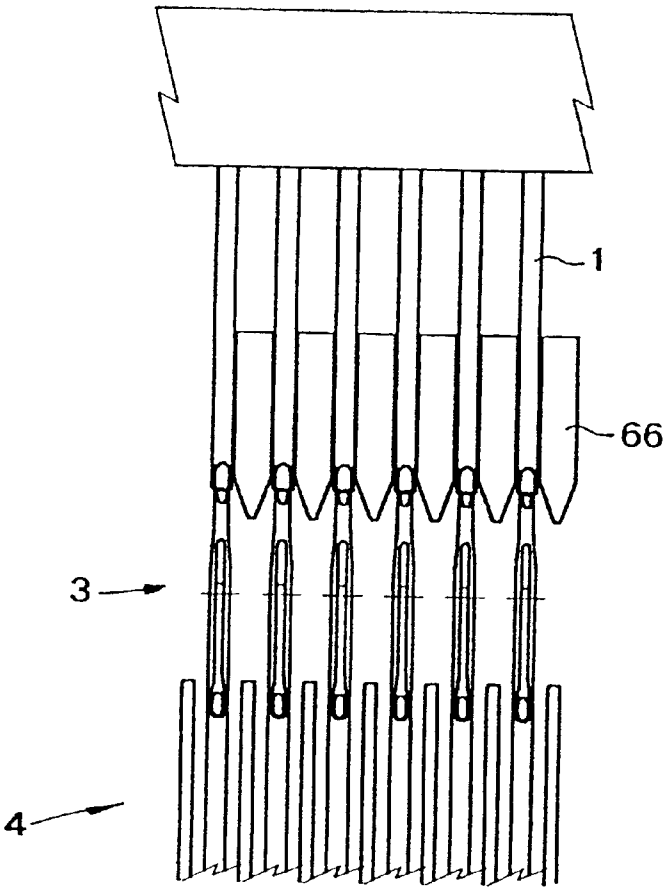
Figure 39:
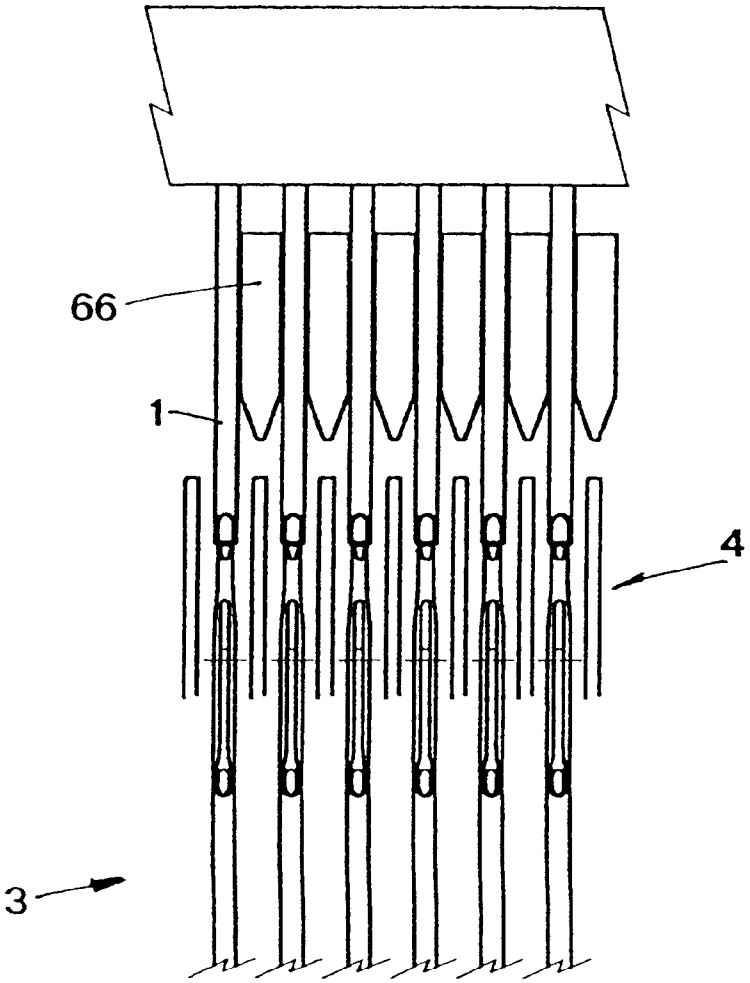

The trasnfer of the stitches from the transfer members (5) to the spikes (6) in the condition shown in FIGS. 33 and 34, as well as the transfer of the stitches from the pushers (1) to the transfer members (5) or to the spikes (6), may be aided by external means such as straight or curved rods able to exert on the stitches a push directed towards the respective target members.

An apparatus according to the invention makes it possible to perform, for example, the following operations:

(a) removing the stitches from the needles of a knitting machine, by means of corresponding pushers (1), laying down said stitches onto transfer members (5) and, finally, fitting them on spikes of a hooking-up machine to operate the hooking-up thereof. By repeating this cycle over a preset number of times, more stitches belonging to one or more articles can be matched, which articles will result joined by the final hooking-up to form a composite article;

(b) removing the stitches from the knitting needles, by means of pushers (1), and taking them onto the transfer members (5) and dispose them afterwards on said pushers having them laid down onto the needles of a knitting machine possibly different from that for starting up. In case this operation relates to stitches of different articles, it is possible to obtain knitted articles of composite kind;

(c) removing the stitches from a knitting machine by means of pushers (1) and disposing them directly onto the spikes of a hooking-up machine. In this case too, the concerned stitches may belong to different articles or products;

(d) removing the stitches from a knitting machine by means of pushers (1) and transferring them onto other pushers (1) to carry out the operations indicated in the preceding paragraphs (a), (b) and (c).

It is understood that the above described operations may also be combined with each other and repeated for a any number of times.

Advantageously, guide means are provided able to be positioned between the pushers (1) and the needles (2; 3) involved in the stitch-changeover and to carry out the proper centering of the needles heads with respect to the seats (12) of corresponding pushers engaged in said stitch-changeover. This is for taking into account possible linearity or dimension defects of the needles (2; 3) or even of the same pushers (1), and of possible defects in the position of various members being involved—as a consequence of the work tolerances of respective supports. For example, with reference to FIGS. 36–39 of the attached drawings, the said guide means may consist of a plurality of flat elements (66), each of which is to be put side by side with a corresponding pusher (1), before operating the exchange of stitches between needles and pushers, with the free end (666) being wedge-like shaped and the opposite end (665) fixed to a corresponding support (64). By interposing these elements (66) between adjacent pushers (1)—the free end of elements (66) protruding by some length beyond the corresponding end of pushers (1) between which they are interposed—a funnel guide is created for the head of each needle (3), said guide having an inlet section wider than the seat (12) of pushers (1) and an outlet section in proximity of the same seat. In this way, the needles (2; 3) will result, upon their moving close to the respective pushers (1), properly guided with their heads being received into said seats (12), also because of the typical elasticity of the same needles, thereby obtaining the desired result even if the head of one or more needles should be considerably misaligned with respect to the corresponding seat (12) of destination. Subsequent to the guide action thus carried out, the elements (66) may be moved away by driving their support (64) into motion so as not to interfere with the next exchange of stitches (7). Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. An apparatus for driving stitches of textile articles, the apparatus comprising:

a support;

at least one element with a body having a stem connected to said support, said stem having a free end with a seat having seat interior surfaces including an interior upper surface defining a seat height, said seat for receiving a leading portion of a member having a stitch thereon to provide a covering condition to exchange the stitch between said member having a stitch thereon and said body after a portion of the leading portion of said member having a stitch thereon is received into said seat of said at least one element, said at least one element being provided, near said free end, on one side of said seat, with a substantially wedge-shaped appendix.

2. An apparatus according to claim 1, wherein a free end of said appendix, at a vertex of said appendix is tapered.

3. An apparatus according to claim 1, wherein said appendix has an end portion bent inwardly toward said seat.

4. An apparatus according to claim 1, wherein the stem of said element is straight.

5. An apparatus according to claim 1, wherein said substantially wedge-shaped appendix has a thickness which is different from a thickness of a remainder of said stem.

6. An apparatus according to claim 1, wherein said substantially wedge-shaped appendix has a thickness which is different from a thickness of a remainder of said stem, said element having dimensions with a width direction dimension greater than said thickness, said element being mounted on said support with said width direction substantially coinciding with a radial direction of said support.

7. An apparatus for driving stitches of textile articles, the apparatus comprising:

a support;

one or more pushers, each of said pushers including a body with a stem connected to said support, each of said pushers having a free end with a seat having seat interior surfaces including an interior upper surface defining a seat height, said seat for receiving a leading portion of a member having a stitch thereon to provide a covering condition to exchange the stitch between said member having a stitch thereon and said body after a portion of the leading portion of said member having a stitch thereon is received into said seat of said pusher; and a transfer member including stitch removal and/or deposition means for removing the stitches from said pushers to lay the stitches down onto corresponding hook-up spikes and/or on further pushers of the same or other apparatus, so as to transfer the stitches between more stations or members for the treatment thereof.

8. An apparatus according to claim 7, wherein said transfer member has a wedge shaped free end.

9. An apparatus according to claim 7, wherein a plurality of transfer members are provided with at least on of said transfer members having a side slot.

10. An apparatus according to claim 7, wherein a plurality of transfer members are provided with at least on of said transfer members a longitudinal slit.

11. An apparatus according to claim 7, wherein a plurality of transfer members are provided with at least on of said transfer members has a "U" profile.

12. An apparatus according to claim 7, wherein a plurality of transfer members are provided with at a leading portion of said members having a concave shape, with the concavity facing outwardly.

13. An apparatus for driving stitches of textile articles, comprising:

a stitch remover for removal of stitches from the respective knitting needles with a support and at least one element with a body having a stem connected to said support; and stitch support for disposing stitches in a condition suitable for hooking-up, wherein said stitch-support includes a plurality of spikes, at least one of said spikes having a free end bent sideway with respect to a longitudinal axis of said at least one of said spikes.

14. An apparatus according to claim 13, further comprising means for guiding the needles as they move close to respective members of said stitch remover.

15. An apparatus according to claim 13, said stem has a free end with a seat having seat interior surfaces including an interior upper surface defining a seat height, said seat for receiving a leading portion of a member having a stitch thereon to provide a covering condition to exchange the stitch between said member having a stitch thereon and said body after a portion of the leading portion of said member having a stitch thereon is received into said seat of said element, said at least one element being provided, in correspondence of a free end of said at least one element, on one side of said seat, with a substantially wedge-shaped appendix.

* * * * *